US008177118B2

(12) United States Patent
Tao

(10) Patent No.: US 8,177,118 B2
(45) Date of Patent: May 15, 2012

(54) DEMOUNTABLE PACKING BOX

(76) Inventor: Jian Tao, Shen Zhen (CN)

( * ) Notice: Subject to any disclaimer, the term of this patent is extended or adjusted under 35 U.S.C. 154(b) by 419 days.

(21) Appl. No.: 12/487,740

(22) Filed: Jun. 19, 2009

(65) Prior Publication Data

US 2010/0320262 A1 Dec. 23, 2010

(51) Int. Cl.
*B65D 3/16* (2006.01)
*B65D 43/22* (2006.01)

(52) U.S. Cl. ..... 229/125.28; 229/4.5; 229/5.5; 229/5.7; 229/104; 229/125.38

(58) Field of Classification Search ..... 229/4.5, 229/5.5, 5.7, 104, 125.01, 125.28, 125.38; 220/315, 375
See application file for complete search history.

(56) References Cited

U.S. PATENT DOCUMENTS 265,985 A * 10/1882 Seabury ..... 229/125.38
696,928 A * 4/1902 Beecher ..... 229/125.38
979,261 A * 12/1910 Compton ..... 229/4.5
1,352,833 A * 9/1920 Robinson ..... 229/125.28
2,329,605 A * 9/1943 Gladstein ..... 229/4.5
2,421,453 A * 6/1947 Crawshaw ..... 229/4.5
2,630,154 A * 3/1953 Sallac ..... 220/315
3,313,333 A * 4/1967 Lordi ..... 229/5.5
3,632,038 A * 1/1972 Souza ..... 229/5.5
3,912,331 A * 10/1975 Turner et al. ..... 229/4.5
3,954,219 A * 5/1976 Mangini et al. ..... 229/122.27
4,478,348 A * 10/1984 Cook ..... 220/315
4,688,692 A * 8/1987 Humbs et al. ..... 220/315
5,269,454 A * 12/1993 Perazzo ..... 229/4.5
5,372,269 A * 12/1994 Sutton et al. ..... 229/125.28
5,638,977 A * 6/1997 Bianchi ..... 220/315
6,789,697 B2 * 9/2004 Neess ..... 229/122.1
7,159,620 B2 * 1/2007 Kissell ..... 138/149
7,263,790 B2 * 9/2007 Richards ..... 40/306
2002/0104847 A1 * 8/2002 Meyer et al. ..... 220/375
2005/0103790 A1 * 5/2005 Masso ..... 220/315
2008/0272132 A1 * 11/2008 Afflerbach et al. ..... 220/682

* cited by examiner

*Primary Examiner* — Gary Elkins
(74) *Attorney, Agent, or Firm* — Jackson IPG PLLC; Demian K. Jackson

(57) ABSTRACT

A demountable packing box of the present invention comprises a main body, an upper cover located at the upper portion of the main body, a lower cover located at the lower portion of the main body, and a plurality of connecting bands respectively connected to the upper cover and the lower cover. The main body is a flat plate with two connecting portions at opposite sides thereof after disassembled. A pair of fixing parts matable with each other is respectively disposed at the two connecting portions of the main body. The upper cover is a flat plate with a predetermined shape. A plurality of upper tabs respectively extends outwards from the periphery of the upper over. The lower cover is a flat plate with a shape corresponding to the upper cover. A plurality of lower tabs extends outwards from the periphery of the lower cover. The upper portion of the main body is provided with a plurality of upper positioning parts corresponding to the upper tabs of the upper cover. The lower portion of the main body is provided with a plurality of lower positioning parts corresponding to the lower tabs of the lower cover.

4 Claims, 2 Drawing Sheets

DEMOUNTABLE PACKING BOX

FIELD OF THE INVENTION

The present invention relates to a packing box, particularly relates to a demountable packing box.

BACKGROUND OF THE INVENTION

Various packing boxes are widely used with different shapes or materials. According to the assembling manner, the packing boxes can be divided into the fixed packing box and the demountable packing box. A fixed packing box can be used directly while storing objects. Since the fixed packing box occupies an unchangeable three-dimensional space, it is inconvenient for storing and transporting the fixed packing box. The conventional demountable packing box assembled by folding and pasting, will be damaged at a certain extent after the packing box is disassembled. Therefore, it can not be reused, which adversely affects the cost of production and use. Moreover, it is required to solve some technical problems of the conventional demountable packing box, particularly to increase the convenience and stability of assembling and using.

SUMMARY OF THE INVENTION

An object of the present invention is to provide a demountable packing box, which can efficiently save the storage space thereby facilitating to store and transport and reducing cost and can be disassembled and assembled easily for easily use and reuse.

Another object of the present invention is to provide a demountable packing box, which can be assembled stably and quickly for increasing weight capacity, and increasing convenience of loading or unloading objects.

To achieve the above mentioned objects, a demountable packing box of the present invention comprises a main body, an upper cover located at the upper portion of the main body, a lower cover located at the lower portion of the main body, and a plurality of connecting bands respectively connected to the upper cover and the lower cover. The main body is a flat plate with two connecting portions at opposite sides thereof after disassembled. A pair of fixing parts matable with each other is respectively disposed at the two connecting portions of the main body. The upper cover is a flat plate with a predetermined shape. A plurality of upper tabs respectively extends outwards from the periphery of the upper over. The lower cover is a flat plate with a shape corresponding to the upper cover. A plurality of lower tabs extends outwards from the periphery of the lower cover. The upper portion of the main body is provided with a plurality of upper positioning parts corresponding to the upper tabs of the upper cover. The lower portion of the main body is provided with a plurality of lower positioning parts corresponding to the lower tabs of the lower cover. The main body is formable with the corresponding shape according to the shape of the upper cover and the lower cover. In assembly, the main body is curved to make the upper and lower tabs of the upper and lower covers to respectively extend through the upper and lower positioning parts, and the fixing parts of the connecting portions of the main body is mated with each other to form the packing box with a fixed containing space.

Wherein the main body, the upper cover, and the lower cover are made of hard paper or plastics.

Wherein the fixing parts are a pair of Velcros.

Wherein one connecting portion of the main body is provided with a groove for containing one Velcro, and the other connecting portion is provided with a cutout for containing the other Velcro.

Wherein the shape of the upper cover is round, elliptic, or polygonal.

Wherein the upper cover is provided with four upper tabs being evenly spaced, and each upper tab is provided with a through hole; the lower cover is provided with four lower tabs being evenly spaced, and each lower tab is provided with a through hole.

Wherein the upper positioning parts of the main body are elongate holes.

Wherein the lower positioning parts of the main body are elongate holes.

Wherein the lower positioning parts of the main body are recess recessed from the lower edge of the main body.

Wherein each end of the connecting band is provided with a positioning member; each connecting band connects with at least one lower tab and at least one upper tab.

The demountable packing box of the present invention can be demounted to be three flat plates and two ropes for easy storage and transportation and saving space of storage and transportation thereby reducing cost. Furthermore, it is easy to assemble and disassemble the packing box of the present invention without any necessary damage, thereby facilitating to use and reuse. Moreover, the packing box of the present invention can increase weight capacity, and increase convenience of loading or unloading objects.

The characteristic and the technical solution of the present invention are best understood from the following detailed description with reference to the accompanying figures, but the figures are only for reference and explaining, not to limit the scope of the invention.

BRIEF DESCRIPTION OF THE DRAWINGS

The technical solution and the beneficial effects of the present invention are best understood from the following detailed description with reference to the accompanying figures and embodiments.

DESCRIPTION OF THE PREFERRED EMBODIMENTS

Hereinafter, the present invention is described detailedly with reference to the accompanying figures.

Figure 1:
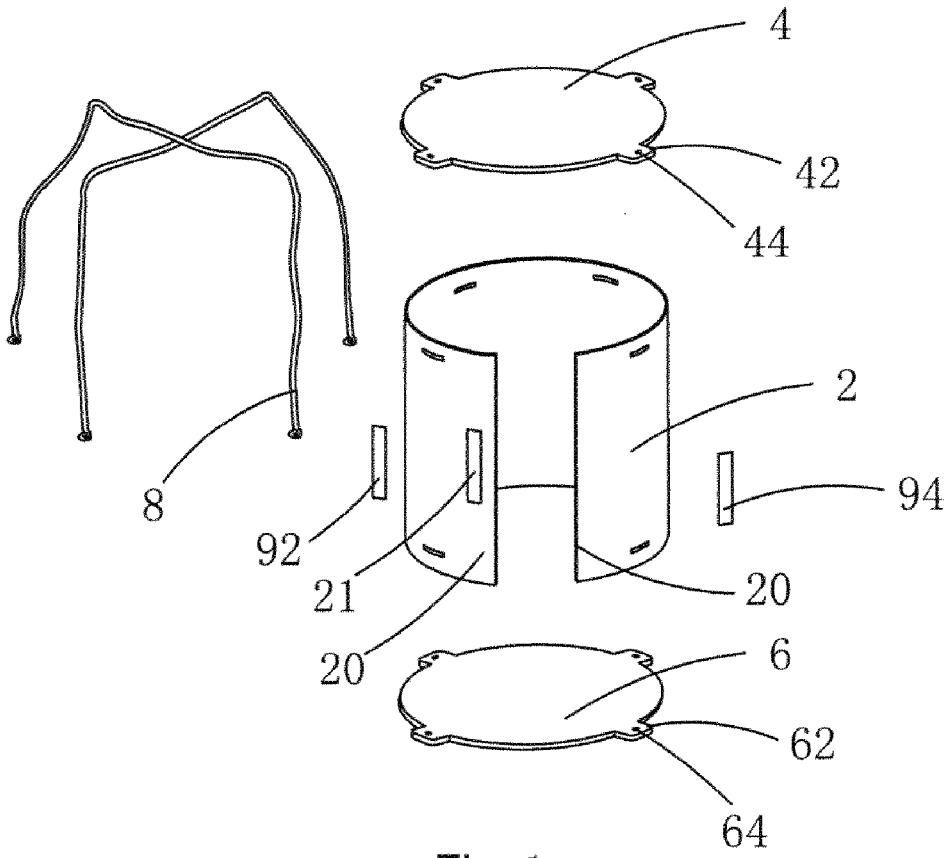
FIG. 1 is an exploded view of a demountable packing box in accordance with a first embodiment of the present invention.
Figure 2:
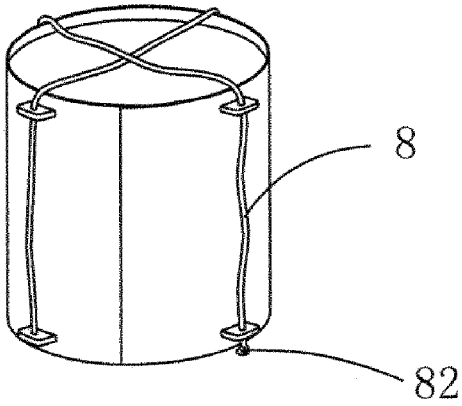
FIG. 2 is an assembled view of FIG. 1.
Figure 3:
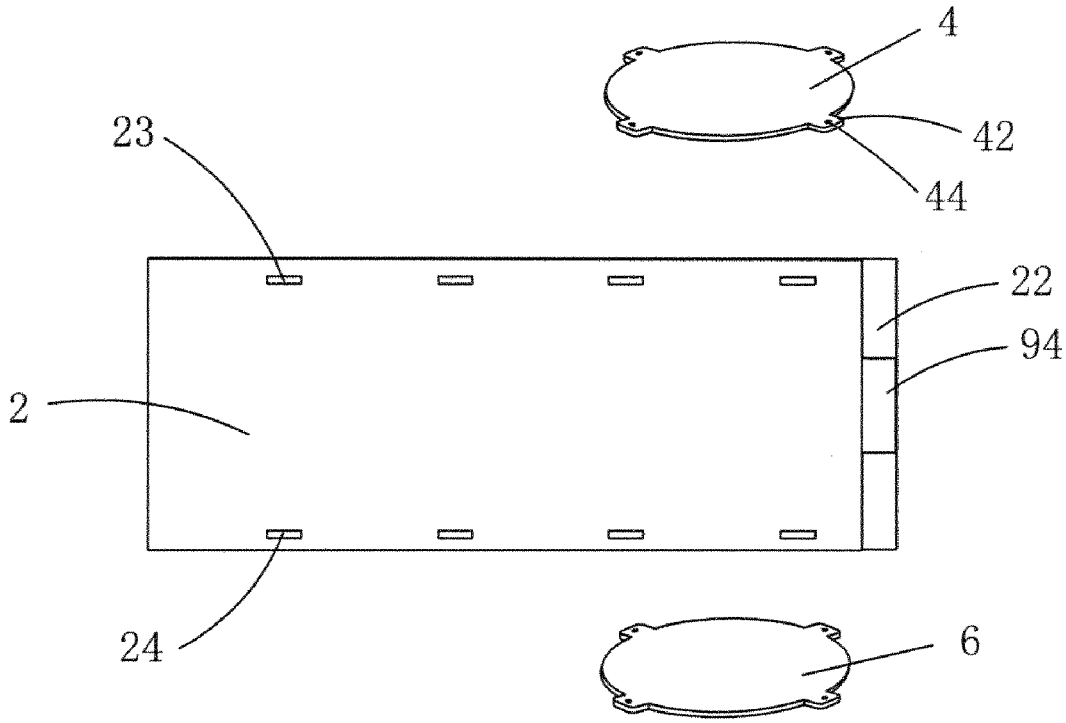
FIG. 3 is a schematic view showing the main body being disassembled to be a flat plate.

Referring to FIGS. 1-3, a demountable packing box of the present invention comprises: a main body 2, an upper cover 4 located at the upper portion of the main body 2, a lower cover 6 located at the lower portion of the main body 2, and a plurality of connecting bands 8 separately connected to the upper cover 4 and the lower cover 6. The main body 2, the upper cover 4, and the lower cover 6 are made of hard paper or plastics (such as the PVC plastic).

The main body 2 is a flat plate with two connecting portions 20 being at opposite sides thereof after the main body 2 is demounted from the demountable packing box. A pair of fixing parts 92, 94 matable with each other are separately disposed at the two connecting portions 20, for connecting the connecting portions 20 together thereby assembling main body 2 with a fixed shape whereby the main body 2, the upper cover 4 and the lower cover 6 cooperatively define a containing space. In this embodiment, the pair of fixing parts 92, 94 is a pair of Velcros 92, 94 matable with each other. One connecting portion 20 of the main body 2 is defined with a groove 21 for containing one Velcro 92, and the other connecting portion 20 is defined with a cutout 22 for containing the other Velcro 94. When the two connecting portions 20 are connected to each other and are fixed via the pair of Velcros 92, 94, the thickness of the connecting position of the two connecting portions 20 is comparatively thin, thereby preventing the connecting position from adversely affecting the shape of the assembled main body.

The upper cover 4 is a flat plate with a predetermined shape which may be round, elliptic, polygonal, and so on. In this embodiment, the upper cover 4 is round. A plurality of upper tabs 42 respectively extend outwards from the periphery of the upper over 4. In this embodiment, the upper cover 4 is provided with four upper tabs 42 being evenly spaced. Each upper tab 42 is defined with a through hole 44.

The lower cover 6 is a flat plate with a shape corresponding to the upper cover 4. In this embodiment, the lower cover 6 is round. A plurality of lower tabs 62 respectively extend outwards from the periphery of the lower over 6. In this embodiment, the lower cover 6 is provided with four lower tabs 62 being evenly spaced. Each lower tab 62 is defined with a through hole 64. In this embodiment, the upper cover 4 has the same structure as the lower cover 6.

A plurality of upper positioning parts 23 is defined at the upper portion of the main body 2 corresponding to the upper tabs 42 of the upper cover 4. In this embodiment, the upper positioning parts 23 are elongate holes. A plurality of lower positioning parts 24 is defined at the lower portion of the main body 2 corresponding to the lower tabs 62 of the lower cover 6. In the present embodiment, the lower positioning parts 24 are elongate holes. The main body 2 is formed with the shape corresponding to the shape of the upper cover 4 and the lower cover 6.

The connecting bands 8 can be conventional nylon ropes with each end thereof being provided with a positioning member 82. The positioning member 82 can be a knot or a conventional unidirectional joint with a barb. The quantity of the connection bands 8 is configured according to the requirement. In this embodiment, the connecting bands 8 are two ropes with the same length.

In assembly, the main body 2 is curved to make the upper and lower positioning parts 22, 24 thereof respectively receive the upper and lower tabs 42, 62 of the upper and lower covers 4, 6 and then to make the fixing parts 92, 94 of the connecting portions 20 thereof be mated with each other, thereby forming the packing box with the fixed containing space. Each connecting band 8 extends through the through holes 64 of opposite lower tabs 62, the through holes 44 of opposite upper tabs 42, with two positioning members 82 thereof respectively abuttable with the opposite lower tabs 62 for preventing the connecting band 8 from leaving the through holes 64 of the lower tabs 62. Two connecting bands 8 intersect above the upper cover 4, and the intersecting position of the connecting bands 8 can be used for handing. Therefore, it is convenient for assembling the demountable packing box of the present invention. Furthermore, the lower cover 6 and the main body 2 are assembled stably through the lower tabs 62 and the lower positioning parts 24 whereby the demountable packing box of the present invention can load a comparatively large weight, and be durable.

In disassembly, the connecting bands 8 are removed from the through holes 64, 44, and then the fixing parts 92, 94 are detached to open the connecting portions 20. The upper and lower tabs 42, 62 respectively leave the upper and lower positioning parts 22, 24 whereby the main body 2 is separated from the upper cover 4 and the lower cover 6. Thus it is ready to disassemble for storage, transportation and reuse.

In use, the fixing parts 92, 94 are detached to open the connecting portions 20. The upper and lower tabs 42, 62 adjacent the fixing part 92 or 94 are disengaged from the connecting band 8 for extending out from the positioning parts 22, 24 thereby the main body 2 is partially disassembled from the upper and lower covers 4, 6. Therefore, the main body 2 is opened at 180 degrees for readily putting gifts in the packing box or take gifts from the packing box.

Figure 4:
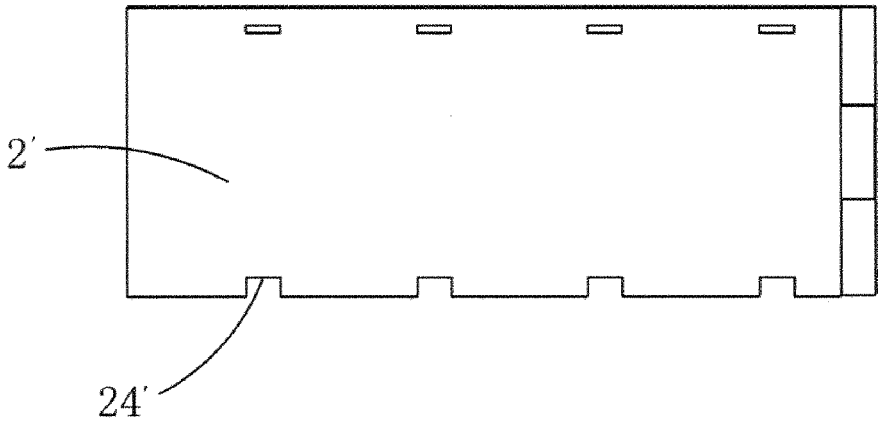
FIG. 4 is a schematic view showing a main body of a demountable packing box in accordance with a second embodiment of the present invention.

Referring to FIG. 4, a lower positioning part 24' of the main body 2' in accordance with another embodiment of the present invention is shown. The lower positioning part 24' is a recess recessed from the lower edge of the main body 2'. In this embodiment, another use manner is provided that the upper cover 4 and the main body 2' can be directly pulled up to put gifts on the lower cover 4 or take gifts from the lower cover 4. So, it is easier and quicker to use.

In summary, the demountable packing box of the present invention can be demounted to be three flat plates and two ropes for easy storage and transportation and saving space of storage and transportation thereby reducing cost. Furthermore, it is easy to assemble and disassemble the packing box of the present invention without any necessary damage, thereby facilitating to use and reuse. Moreover, the packing box of the present invention can increase weight capacity, and increase convenience of loading or unloading objects.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A demountable packing box comprising:

a main body being a flat plate with two connecting portions at opposite sides thereof, a pair of fixing parts matable with each other being respectively disposed at the two connecting portions of the main body;

an upper cover located at an upper portion of the main body, the shape of the upper cover being round or elliptic, a plurality of upper tabs respectively extending outwards from the periphery of the upper over;

a lower cover located at the lower portion of the main body, the lower cover being a flat plate with a shape corresponding to the upper cover, a plurality of lower tabs extending outwards from the periphery of the lower cover; and a plurality of connecting bands respectively connected to the upper cover and the lower cover;

the upper portion of the main body being provided with a plurality of upper positioning parts corresponding to the upper tabs of the upper cover, the lower portion of the main body being provided with a plurality of lower positioning parts corresponding to the lower tabs of the lower cover, the main body being curved to make the upper and lower tabs of the upper and lower covers to respectively extend through the upper and lower positioning parts, and the fixing parts of the connecting portions of the main body being mated with each other to form the packing box with a fixed containing space, wherein each end of each connecting band is provided with a positioning member; each connecting band connects with at least one lower tab and at least one upper tab.

2. The demountable packing box of claim 1, wherein the main body, the upper cover, and the lower cover are made of hard paper or plastics.

3. The demountable packing box of claim 1, wherein the upper positioning parts of the main body are elongate holes.

4. The demountable packing box of claim 1, wherein the lower positioning parts of the main body are elongate holes.

* * * * *